United States Patent [19]

Irwin et al.

[11] Patent Number: 4,501,285

[45] Date of Patent: Feb. 26, 1985

[54] ULTRASONIC CLEANING APPARATUS

[75] Inventors: Charles Irwin, Santa Ana, Calif.; Janet Devine, Downingtown, Pa.; Richard Kramer, Wilmington, Del.

[73] Assignee: Sonobond Ultrasonics, Inc., Pa.

[21] Appl. No.: 365,569

[22] Filed: Apr. 5, 1982

[51] Int. Cl.[3] ..... B08B 3/12

[52] U.S. Cl. ..... 134/58 R; 134/184; 366/127

[58] Field of Search ..... 134/1, 58 R, 184; 366/127

[56] References Cited

U.S. PATENT DOCUMENTS

| | | | |
|---|---|---|---|
| 2,498,737 | 2/1950 | Holden | 366/127 X |
| 3,094,314 | 6/1963 | Kearney et al. | 134/1 X |
| 4,064,885 | 12/1977 | Dussault et al. | 134/184 X |
| 4,183,011 | 1/1980 | Massa | 134/184 |
| 4,401,131 | 8/1983 | Lawson | 134/184 X |

*Primary Examiner*—Richard V. Fisher
*Assistant Examiner*—W. Gary Jones
*Attorney, Agent, or Firm*—Austin R. Miller

[57] ABSTRACT

Ultrasonic transducer apparatus for cleaning applications and method for cleaning wafers of semiconductor material in which the method includes positioning the wafer proximate to but closely spaced away from a cleansing face of the ultrasonic transducer, supplying space between the cleansing face and the wafer with a cleansing fluid through an orifice in the cleansing surface and ultrasonically vibrating the cleansing face transversely to the wafer by applying an electrical signal to piezoelectric material symmetrically disposed about the orifice in the cleansing face via which the cleansing fluid is supplied, with the ultrasonic transducer including piezoelectric material symmetrically disposed with respect to the orifice in the cleansing face through which the cleansing fluid is supplied. The piezoelectric material is preferably in the form of a plurality of discreet piezoelectric elements which are provided with an input signal via a common input terminal where all of the plurality of piezoelectric elements are mechanically coupled to the cleansing face so that the piezoelectric elements, the mechanical coupling structure and a cleansing face ultrasonically vibrate as a single integral structure.

7 Claims, 3 Drawing Figures

ULTRASONIC CLEANING APPARATUS

FIELD OF THE INVENTION

This invention relates to ultrasonic cleaning.

DESCRIPTION OF THE PRIOR ART

U.S. Pat. No. 4,064,885 discloses cleaning semiconductor wafers by supporting the wafer on a rotating shaft and causing liquid solvent to flow continuously across the wafer while the wafer rotates. Ultrasonic energy is applied to the liquid, causing cavitation in the liquid thereby cleaning the wafer.

Other approaches to ultrasonic cleaning have used vibrating tanks or have used transducers at least partially immersed in cleaning liquid in the tank. In the latter case cavitation wear on the immersed ends of the transducers has limited transducer service life to an unacceptably short time.

With growth in electronics, there is high demand for processed semiconductor material from which to manufacture electronic components. For successful processing of the semiconductor material prior to manufacturing the electronic components, the material must be extremely clean. Heretofore there have not been apparatus or methods available which adequately cleaned semiconductor material at a desired rate for economical processing of the semiconductor material prior to the material being incorporated into electronic components. This invention is directed towards solving that problem.

SUMMARY OF THE INVENTION

This invention provides methods and apparatus for ultrasonic cleaning.

Apparatus of the invention includes a cleaning faceplate with a passageway therethrough opening onto a cleansing surface of the faceplate for flow of cleansing process fluid therefrom over the cleansing surface. A conduit communicates with the passageway remote from the cleansing surface opening and supplies the fluid to the passageway. Piezoelectric means convert an electrical input signal into mechanical vibration. Means are provided for mechanically applying the piezoelectric means mechanical vibration to the faceplate symmetrically about the opening of the passageway in a direction transverse to the cleansing surface. Means are provided for supplying electrical input signal to the piezoelectrical means. The faceplate is easily replaceable in the event of faceplate wear. A number of piezoelectric means are mechanically coupled to define a single ultrasonic transducer, where the piezoelectric means are symmetrical about the opening through which the fluid flows.

In one embodiment of apparatus manifesting the invention the ultrasonic transducer for converting electrical energy into mechanical vibratory energy includes a piezoelectric element support assembly having first and second outer sandwich member sandwiching a metallic plate therebetween where the first and second sandwich members each are electrically insulative material and include receptacles for receiving piezoelectric elements therewithin. The receptacles communicate with the plate sandwiched between the first and second sandwich members. The piezoelectric elements reside within the receptacles with each piezoelectric element in contact with the plate. A support plate has a passageway therethrough and supports a faceplate which includes a cleansing surface and a passageway therethrough exiting centrally of the cleansing surface. Means are provided for releasably retaining the faceplate in integral facing contact with the support plate so that passageways through the support plate and the faceplate communicate. The metallic plate provides a common high voltage signal to the piezoelectric elements. The sandwich members are retained together by compression application means and are easily disassembled if replacement of the metallic plate or the input signal wire connection thereto is required.

The support plate and the faceplate can be a single piece.

Preferably, the piezoelectric elements are in pairs with elements of a single pair aligned with respect to a line transverse to the cleansing surface of the faceplate. The piezoelectric element pairs are symmetrical with respect to a longitudinal axis of the passageway through the faceplate exiting centrally of the cleansing surface. The piezoelectric elements are fed from a common terminal.

As used herein in connection with the piezoelectric elements the term "vibrate" refers to the property of those elements whereby when an alternating voltage is applied to an element, the element converts the alternating voltage into a cyclical strain of the same frequency as the alternating voltage. The strain is proportional to the level of the applied voltage.

THE DRAWINGS

DETAILED DESCRIPTION OF THE INVENTION AND BEST MODE CONTEMPLATED FOR PRACTICE THEREOF

Figure 1:
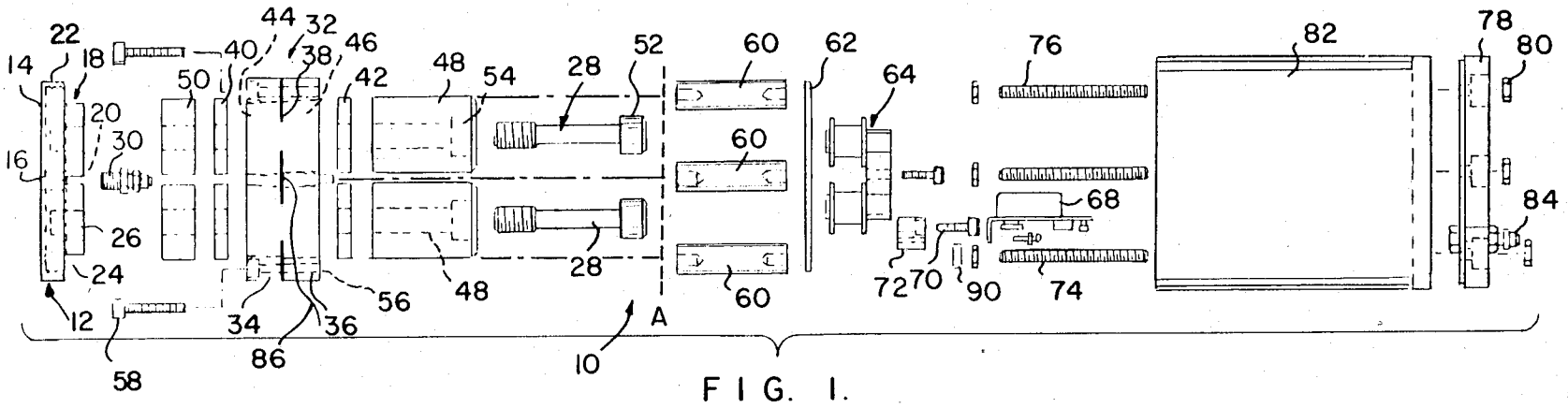
FIG. 1 is an exploded side view of transducer apparatus manifesting the invention.

Referring to FIG. 1, transducer apparatus manifesting the invention is designated generally 10 and includes a cleaning faceplate 12 having a preferably circular cleansing surface 14 over which a cleansing process fluid flows. The fluid exhausts through a passageway 16 which extends entirely through faceplate 12, preferably in a direction generally transverse to cleansing surface 14. A support plate 18 located immediately behind faceplate 12 includes a passageway 20 which communicates with passageway 16 when support plate 18 and cleansing faceplate 12 facingly contact with plate 18 supporting plate 12, as depicted in FIG. 1.

Faceplate 12 includes a circumferential lip 22 extending around faceplate 12 and threads, not numbered in FIG. 1, which engage corresponding threads formed about the circumference of support plate 18. The surface of plate 12 opposite cleansing surface 16 is preferably planar as is the facingly contacted surface of plate 18. Thus, when the respective threads are engaged, plates 18 and 12 are effectively an integral, unitary assembly. The threaded engagement of plate 12 with plate 18 permits rapid replacement of plate 12 when it becomes worn.

Plate 18 further includes lugs 24 extending oppositely from the planar surface which facingly contacts the unnumbered planar back surface of plate 12, with bores 26 in lugs 24 being internally threaded to receive compression bolts 28, as described below.

Passageway 20 is internally threaded to receive fitting 30 forming a portion of a conduit for supplying cleansing process fluid to passageway 16 for flow over cleansing surface 14.

Cleansing faceplate 12 is preferably circularly configured with passageway 16 located at the center of the circular periphery of cleansing surface 14.

A piezoelectric element support assembly is designated generally 32 and includes respective first and second outer sandwich members 34, 36 which are electrically insulative material, preferably Micarta. Sandwiched between members 34, 36 is a terminal spacer plate 38, which is preferably copper and has outer diameter slightly less than outer diameter of preferably cylindrically configured sandwich members 34, 36. First outer sandwich member 34 preferably has a small annular recess therein, at the surface facing second outer sandwich member 36, for receipt of terminal spacer plate 38. Both first and second outer sandwich members 34, 36 are bored to receive preferably cylindrial wafer-like first and second piezoelectric elements 40, 42 respectively; the bores extending through first and second sandwich members 34, 36 are denoted 44, 46 respectively. Bores 44, 46 pass entirely through their respective sandwich members so that piezoelectric elements 40, 42 contact terminal spacer plate 38 and receive an electrical input signal therefrom.

Rear bells 48 facingly contact piezoelectric elements 42 within bores 46, press piezoelectric elements 42 against plate 38 and provide a second electrical connection for piezoelectric elements 42 so that the circuit supplying the input electrical signal to piezoelectric elements 42 may be completed. Rear bells 48 are preferably stainless steel cylinders and are bored, as indicated by the unnumbered, dotted lines, to receive compression bolts 28. These parts are easily disassembled by removing compression bolts 28 and bolts 58 if repair or replacement of plate 38 or the connection of wire 86 thereto is required.

Forward bells 50, similarly to rear bells 48, contact piezoelectric elements 40 at the surfaces thereof opposite terminal plate 38, urge piezoelectric elements 40 into contact with plate 38 and reside partially within bores 44 formed in first member 34. Contact between forward bells 50 and piezoelectric elements 40 permits completion of the circuit via which inout signal is supplied to piezoelectric elements 40. Forward bells 50 are cylindrically configured, are preferably stainless steel and include unnumbered central bores, as indicated by the dotted lines in FIG. 1.

Assembly of the piezoelectric elements 40, 42 and their supporting apparatus to cleaning faceplate 12 is accomplished by serially inserting compression bolts 28 through unnumbered longitudinal internal bores in rear bells 48, in piezoelectric elements 42, in second outer sandwich member 36, in terminal spacer plate 38, in first outer sandwich member 34, in piezoelectric elements 40, in forward bells 50 and then threading compression bolts 28 into internally threaded bores 26 formed in lug portions 24 of support plate 18. Enlarged head portions 52 of compression bolts 28 received by counterbores 54 in rear bells 50 serve to position the shafts of bolts 28 centrally within the unnumbered longitudinal bores of rear bells 48, piezoelectric elements 42, second sandwich member 36, terminal spacer plate 38, first sandwich member 34, piezoelectric elements 40, and forward bells 50.

The unnumbered central longitudinal bores in piezoelectric elements 40, 42 and those in terminal spacer plate 38 are slightly larger than outer diameter of the shaft of compression bolt 28 so compression bolt 28 does not contact the interior annular surfaces of the bores through piezoelectric elements 40, 42 and plate 38 within which bolt 28 resides.

The cylindrical configurations of bores 44, 46, piezoelectric elements 40, 42 and rear and forward bells 48, 50 serve to align the serial combination of the bells, the piezoelectric elements and the sandwich members about the centerline of the longitudinal central bores passing through these elements. This, in combination with the reduced outer diameter of bolts 28 with respect to the bores internal of piezoelectric elements 40, 42 and terminal spacer plate 38, prevents bypass shorting of the circuit via which the input signal is supplied to piezoelectric elements 40, 42, as explained below.

Sandwich members 34, 36 further include communicating bores 56 for passage therethrough of bolts 58 which are received by unnumbered threaded bores in cylindrical, preferably aluminum, spacers 60. The bolt-spacer combination 58, 60 serves to connect the assembly of piezoelectric electric elements 40, 42, their support members and cleaning faceplate 12 to a mounting plate 62. A pickup magnet-coil assembly 64 is affixed to mounting plate 62 by a machine screw 66 and a nut, not shown, on the opposite side of plate 62 from screw 66.

A feedback circuit board 68 is connected to magnet-coil combination 64 via a wire, not shown, and receives a signal from magnet-coil combination 64 which is indicative of the amplitude of vibration of the transducer defined by the integral combination of the elements to left of dash line A in FIG. 1. Magnet-coil combination 64 is positioned with the magnet bottom sufficiently close to the end of one of rear bells 48 so that as the rear bell 48 vibrates, the magnetic flux in that area changes and the coil portion of the magnet-coil combination 64 senses this change in magnetic flux. Signal from magnet-coil combination 64 is provided to feedback circuit board 68 which in turn provides, via another wire which is not shown, a regulating signal to the power supply which supplies the input signal to piezoelectric elements 40, 42 via terminal spacer plate 38. Suitable magnet-coil combinations 64, feedback circuit boards 68 and power supplies, (not shown) are all within the knowledge of those of skill in the art and, hence, are not further described herein.

A machine screw 70 secures an insulative spacer 72, preferably manufactured of Delrin, to magnet-coil combination 64. Feedback circuit board 68 is secured to spacer 72 by screw 74 which passes through a tab of board 68 and into spacer 72, as indicated by dash lines in FIG. 1.

Bores in ends of spacers 60 opposite the ends receiving screws 58 are threaded and receive threaded rods 76, to which a top member 78 is secured by nuts threadedly engaging rods 76. A cylindrical exterior housing, in conjunction with the cleaning faceplatesupport plate 12, 18 combination and top 78, encloses the transducer apparatus.

Top 78 has a fitting 84 to which the flexible conduit from fitting 30 is connected, the conduit not being shown in FIG. 1. The cleaning process fluid, preferably deionized water, is supplied to this conduit, and hence to cleansing surface 14 via conduit 16, via fitting 84 which is connected to an external source of cleaning process fluid not illustrated in drawing.

Input signal is provided to terminal spacer plate 38 via a wire 86 which also may pass through a fitting such as 84 in top 78 and is connected to the power supply for the transducer. Wire 86 is, of course, insulated. The other side of the circuit, from the sides of piezoelectric elements 40, 42 which do not contact terminal spacer plate 38, is provided via forward and rear bells 50, 48 which are commonly connected to support plate 18 via compression bolts 28. Forward bells 50 are urged against support plate 18 by the compressive action of bolts 28 while rear bells 48 are in contact with the head portions of bolts 28. Since all bells 48, 50 are connected to support plate 18, all bells 48, 50 have a common electrical signal applied thereto. Hence the outwardly facing (with respect to terminal spacer plate 38) faces of piezoelectric members 40, 42 all have a common electrical signal applied thereto. Similarly, the inwardly facing (with respect to terminal spacer plate 38) faces of piezoelectric elements 40, 42, all being in contact with terminal spacer plate 38, have a common input signal applied thereto. Thus all of the piezoelectric elements 40, 42 have the same electrical signal applied simultaneously thereto.

Connection to the side of the circuit opposite that of wire 86 is provided via ground connector 90 which is pressed against a spacer 60 by a nut 92 threadedly engaging one of threaded rods 76. Good electrical connection between aluminum spacer 60 and two of the rear bells 48 is provided via a spring contact strip 94, illustrated in FIG. 3, which is preferably beryllium copper or spring steel and is spring fitted between spacer 60 and two rear bells 48 as illustrated in FIG. 3.

A suitable insulated wire is connected to ground connector 90, fed out of the transducer housing via a fitting 84 and connected to the power supply sending the input signal to the transducer. Similarly, feedback signal produced by feedback circuit board 68, which is indicative of any change required in the amplitude of the input signal supplied via wire 86 by the power supply, may be provided to the power supply for regulation thereof via insulated lead wires exiting the housing via a fitting 84; such lead wires are not shown to insure the clarity of the drawing.

Figure 3:
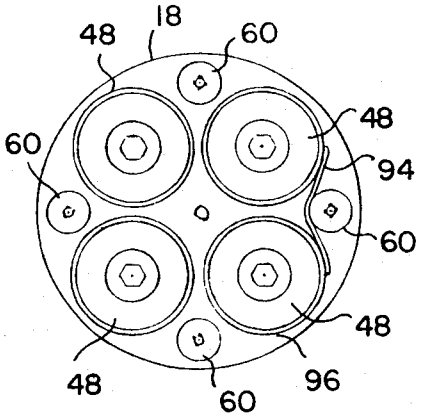
FIG. 3 is a view taken at 3—3 in FIG. 2.

The symmetrical arrangement of the forward and rear bell-piezoelectric element combinations with respect to the center of circular faceplate 12 and support plate 18 is illustrated in FIG. 3. Also illustrated in FIG. 3 is the conduit 96 which connects fitting 84 with fitting 30 for supplying the cleaning process fluid to passageway 16 for distribution over the circular cleansing surface 14 of cleaning faceplate 12.

Figure 2:
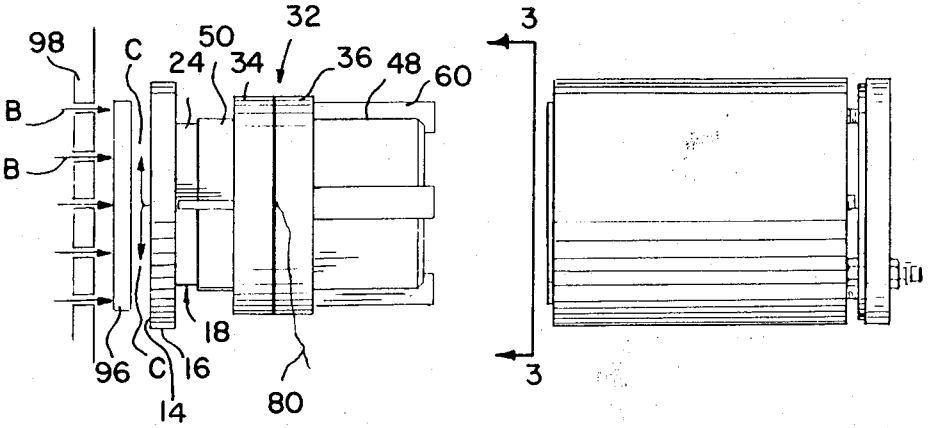
FIG. 2 is a side view of transducer apparatus manifesting the invention in which the outer housing of the transducer apparatus has been displaced to the right and in which cleansing of a wafer of semiconductor material is depicted schematically.

FIG. 2 illustrates the assembled transducer, but with housing 82 and top 78 moved to the right of arrows 3—3, to illustrate the transducer internal configuration. In the assembled condition, with bolts 28 securely threaded into bores 26 in lugs 24, piezoelectric elements 40, 42, sandwich members 34, 36, bells 48, 50 and plates 12, 18 are a single integral structure.

When apparatus of the invention is used to clean a wafer 96 of semiconductor material, as in FIG. 2, the apparatus is configured vertically above wafer 96 and is retained in position by support means, not shown. Wafer 96 is preferably supported by an air cushion, designated by arrows B in FIG. 2, above a track 98. Wafer 96 is preferably rapidly rotated during the cleaning process. As the preferred deionized water cleaning process fluid is supplied via conduit 16, the fluid fills the space between wafer 96 and cleansing surface 14 of cleaning faceplate 12, as indicated by arrows C in FIG. 2. Space between cleansing surface 14 and wafer 96 is preferably about 0.035 inches. Cavitation of cleaning process fluid produced by vibration of the transducer, particularly by vibration of cleaning faceplate 12, provides the cleaning effect of the wafer 96. The cleaning process fluid is preferably continuously supplied, to carry away debris removed from wafer 96 during the cleaning process.

The threaded connection of cleaning faceplate 12 and support plate 18 permits rapid replacement of cleaning faceplate 12 when cleansing surface 14 becomes worn. This is highly desirable since cleaning faceplate 12, which may be made of aluminum, may wear out very quickly—in a relatively few hours. Connection means other than threads may also be used; it is desirable that the connection means facilitate rapid replacement of a worn faceplate. As yet another alternative, faceplate 12 and support plate 14 may be a single integral member.

Front and rear bells 50, 48 in combination with compression bolts 28 apply pressure on the piezoelectric crystal elements 40, 42 so that the piezoelectric elements 40, 42 are maintained in proper compression. If pressure is too high, piezoelectric elements 40, 42 cannot vibrate. Conversely, if pressure is too low piezoelectric elements 40, 42 will self destruct as they vibrate when electrical signal is applied thereto. Suitable piezoelectric elements 40, 42 are available from Channel Industries.

Length of the forward and rear bells 50, 48 is a function of the selected design frequency.

Connecting wire 86 is preferably looped through a hole in plate 38 and then soldered thereto, assuring good electrical connection.

The configuration of the piezoelectric element support assembly 32 effectively permits four subtransducers, each defined by an axially aligned combination of first and second piezoelectric elements 40, 42 and the forward and rear bells 50, 48 in contact therewith to operate in phase with one another from a common high voltage provided via terminal spacer plate 38. This configuration permits rapid repair and/or replacement of piezoelectric elements 40, 42 and the electrical connections thereto provided by forward and rear bells 50, 48 and terminal spacer plate 38. With this configuration of the piezoelectric element support assembly, the apparatus of the invention works as a single transducer, having multiple piezoelectric elements, which work in unison due to their common high voltage contact. Similarly, common feedback provided by feed of signal from all of forward and rear bells 50, 48 to a common, single feedback circuit is sufficient to regulate the amplitude of vibration of the transducer. Multiple feedback circuits are not required to match the subtransducers to the load because all of the axially aligned piezoelectric element combinations work in unison one with another thereby defining a single, large transducer operating in response to a single input signal.

When apparatus manifesting the invention is assembled, compression bolts 28 may be tightened to specific torque to achieve desired pressure on the piezoelectric elements 40, 42. Alternately, the parts may be held in a hydraulic press, set to a preselected pressure, while the bolts are tightened.

In the preferred embodiment of the invention, the transducer is designed to operate at a 20,000 Hz nominal frequency, with a tolerance of ±1,000 Hz. Pressure of 9,000 psi is applied to the piezoelectric elements 40, 42. Piezoelectric element pressures from about 7,000 psi to about 12,000 psi are permissible.

the symmetric arrangement of the "subtransducer" elements (defined by a single forward bell 50-piezoelectric member 40-piezoelectric member 42-rear bell 48 sandwich) about passageway 16 and with respect to circular cleansing surface 14 assures that cleaning faceplate 12 vibrates substantially uniformly, transversely to cleansing surface 14.

We claim:

1. An ultrasonic transducer for cleaning applications, comprising:

a. a support plate including a passageway therethrough proximate the central portion thereof;

b. a faceplate including a cleansing surface and a passageway therethrough exiting centrally of said cleansing surface;

wherein said support plate passageway and said faceplate passageway communicate and said support plate facingly contacts said faceplate to support same;

c. means for releaseably retaining said faceplate in integral facing contact with said support plate with said passageways in fluid communication;

d. a conduit in fluid communication with said passageways for supplying cleansing fluid to said cleansing surface of said faceplate via said faceplate and support plate passageways;

e. piezoelectric means for converting an electrical input signal to vibrational mechanical energy;

f. means for mechanically coupling said piezoelectric means to said support plate;

g. means for adjustably mechanically compressing said piezoelectric means within a preselected pressure range;

h. sensor means for measuring amplitude of vibration of said piezoelectric means;

i. means for supplying said electrical input signal to said piezoelectric means; and j. feedback circuit means, receiving from said sensor means a signal indicative of amplitude of vibration of said transducer, for regulating amplitude of signal input to said piezoelectric means by said signal supplying means.

2. An ultrasonic transducer for cleaning operations, comprising:

a. a piezoelectric element support assembly including:

i. first and second sandwich members;

ii. a metal plate sandwiched between said first and second members; wherein said first and second members are electrically insulative and include receptacles for receiving piezoelectric elements therein, said receptacles communicating with said plate sandwiched between said first and second members;

iii. piezoelectric elements within said receptacles, each piezoelectric element contacting said plate;

wherein said piezoelectric elements and said plate have corresponding communicating clearance holes therethrough;

b. a support plate having a passageway therethrough;

c. a faceplate including a cleansing surface and a passageway therethrough exiting centrally of said cleansing surface;

d. means for releasably retaining said faceplate in integral facing contact with said support plate so said support plate and said faceplate passageways communicate;

e. a conduit, communicating with said communicating passageways of said support and faceplates, for supplying cleansing fluid to said cleansing surface of said faceplate via said support and faceplate communicating passageways;

f. means for retaining said piezoelectric elements in contact with said metal plate and mechanically coupling said piezoelectric elements to said support plate for unitary vibration thereof upon application of an input electrical signal to said piezoelectric means; and g. means for supplying an electrical input signal to said piezoelectric elements via said metallic plate.

3. The transducer of claim 2, wherein said piezoelectric elements are disposed symmetrically with respect to an axis passing through an orifice defining the exit of said passageway in said cleansing surface.

4. The transducer of claim 3, wherein said piezoelectric elements are disposed in two strata, each stratum being arranged symmetrically with respect to said axis.

5. The transducer of claim 4, wherein said piezoelectric elements are arranged in pairs symmetrically with respect to said axis, with the two elements defining each pair being aligned, lines of pair alignment being parallel with said axis through said orifice.

6. An ultrasonic transducer for converting electrical energy into mechanical vibratory energy, especially adapted for cleaning operations, comprising:

a. a piezoelectric element support assembly including:

i. a first outer sandwich member;

ii. A second outer sandwich member;

iii. a metal plate sandwiched between said first and second members; wherein said first and second members each are electrically insulative material and include receptacles for receiving piezoelectric elements therein, said receptacles communicating with said plate member sandwiched between said first and second insulative members;

iv. piezoelectric elements resident within said receptacles, each piezoelectric element in facing contact with said plate;

wherein said piezoelectric elements and said plate have corresponding communicating clearance holes therethrough;

b. a support plate having passageway therethrough;

c. a faceplate including a cleansing surface and a passageway therethrough terminating in an orifice centrally of said cleansing surface;

d. means for releasably retaining said faceplate in integral facing contact with said support plate so that said support plate and faceplate passageways communicate;

e. a conduit in fluid communication with said communicating passageways of said support and faceplates, passing through a central bore in said piezoelectric element support asembly, including a threaded fitting at an outlet thereof engaging a threaded receptacle defining at least a portion of said passageway through said support plate, for supplying cleansing fluid to said cleansing surface of said faceplate via said communicating passagways of said support and faceplates;

f. forward bell means in facing contact with said piezoelectric means residing within one of said sandwich members, an opposite side thereof in facing contact with said support plate, for transmitting mechanical vibration of said piezoelectric means to said support plate and hence to said faceplate;

g. rear bell means facingly contacting piezoelectric means residing within said remaining sandwich member, said rear bell means being of selected length to define selected frequency of said transducer;

wherein said forward and rear bell means include bores therethrough communicating with corresponding bores through said piezoelectric means, said metal plate and said sandwich members;

h. means passing serially through said rear bell means, a piezoelectric element within said second sandwich member, said plate, a piezoelectric element within said first sandwich member, said forward bell means and received by said support plate, for applying pressure to said piezoelectric elements and for retaining said forward and rear bells, said piezoelectric element support assembly and said support plate in integral, unitary disposition;

i. a magnet-coil combination for sensing changes in magnetic flux density as said rear bell vibrates unitarily with said piezoelectric members, for measuring said flux density changes and producing an electrical signal indicative thereof;

j. feedback circuit means receiving the signal from said magneti-coil combination for regulating amplitude of a signal supplied by a power supply to said piezoelectric means; and k. said power supply furnishing an electrical input signal to said piezoelectric elements via said metal plate.

7. An ultrasonic cleaning transducer comprising:

(a) a faceplate having orifice means therein opening centrally and symmetrically onto a faceplate cleansing surface for flow of cleansing process fluid therefrom over said cleansing surface;

(b) means for supplying said fluid to said orifice means;

(c) piezoelectric means for converting an electrical signal into mechanical vibration and vibrating said faceplate;

wherein said orifice exits centrally and symmetrically onto said cleansing surface; and further comprising:

(d) means for mechanically coupling said piezoelectric means to said faceplate;

(e) means for adjustably compressing said piezoelectric means within a preselected pressure range;

(f) means for measuring amplitude of vibration of said piezoelectric means;

(g) means for supplying said electrical signal to said piezoelectric means; and (h) feedback means, receiving from said measuring means a signal indicative of amplitude to vibration of said transducer, for regulating signal amplitude input to said piezoelectric means by said signal supplying means.

* * * * *